US006343965B1

(12) United States Patent
Biggs et al.

(10) Patent No.: US 6,343,965 B1
(45) Date of Patent: Feb. 5, 2002

(54) PNEUMATICALLY ACTUATED MARINE ENGINE WATER DRAIN SYSTEM

(75) Inventors: Timothy M. Biggs, Stillwater; William E. Hughes, Perry; Andrew K. Logan, Stillwater; Matthew W. Jaeger, Stillwater; Brian R. White, Stillwater, all of OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/643,612

(22) Filed: Aug. 22, 2000

(51) Int. Cl.[7] ..... B63H 21/38
(52) U.S. Cl. ..... 440/88; 123/41.14
(58) Field of Search ..... 440/88; 123/41.14

(56) References Cited

U.S. PATENT DOCUMENTS

| | | | | | |
|---|---|---|---|---|---|
| 4,126,108 | A | * | 11/1978 | Christensen | 123/41.14 |
| 4,533,331 | A | | 8/1985 | Bland | 440/88 |
| 4,699,598 | A | | 10/1987 | Bland et al. | 440/88 |
| 4,741,715 | A | | 5/1988 | Hedge | 440/88 |
| 4,875,884 | A | | 10/1989 | Meisenburg | 440/88 |
| 5,334,063 | A | * | 8/1994 | Nanami | 440/88 |
| 5,362,266 | A | | 11/1994 | Brogdon | 440/88 |
| 5,628,285 | A | | 5/1997 | Logan et al. | 123/41 |
| 5,980,342 | A | | 11/1999 | Logan et al. | 440/88 |
| 6,050,867 | A | | 4/2000 | Shields et al. | 440/88 |
| 6,089,934 | A | | 7/2000 | Biggs et al. | 440/88 |
| 6,135,064 | A | * | 10/2000 | Logan et al. | 123/41.14 |

* cited by examiner

*Primary Examiner*—Sherman Basinger
(74) *Attorney, Agent, or Firm*—William D. Lanyi

(57) ABSTRACT

A drain system for a marine vessel is provided which includes one or more pressure actuated valves associated with the coolant water drain system. The boat operator is provided with a pressure controller that allows pressure to be introduced into the system for the purpose of actuating the drain valves and, as a result, opening various drain conduits to allow cooling water to drain from the engine cooling system into the bilge or overboard.

18 Claims, 6 Drawing Sheets

PNEUMATICALLY ACTUATED MARINE ENGINE WATER DRAIN SYSTEM

BACKGROUND OF THE INVENTION

1. Field of the Invention

The present invention is generally related to a drain system for a marine propulsion engine and, more particularly, to a drain system that utilizes pressure actuated valves to open one or more drain passages to allow water to drain from the engine block and various other components of the marine propulsion system.

2. Description of the Art

Marine propulsion systems used for pleasure craft or working boats of various sizes typically use water from the body of water in which they are operated for engine cooling functions. This water is used in the cooling systems of the marine propulsion devices. Whether the marine propulsion cooling system is an open system, in which sea or lake water is passed through the engine to directly remove heat from the engine, or a closed system in which lake or sea water is drawn into a heat exchanger to remove heat from a coolant that is enclosed within a recirculated system to remove heat from the engine, lake or sea water is continually conducted through various conduits of the cooling system. It is therefore important to be able to remove the lake or sea water from the many passages and conduits of the marine propulsion system in order to avoid trapped water that could freeze and cause serious damage to the propulsion system.

It is common to provide a marine propulsion system with numerous openings through which cooling water can be drained, either into the bilge of the boat or overboard. Many different techniques and processes have been developed in order to facilitate the draining of the cooling system of a marine propulsion device by the operator.

U.S. Pat. No. 5,362,266, which issued to Brogdon on Nov. 8, 1994, describes a fresh water flushing system for a marine engine in a boat for use, whether the boat is in or out of the water. The system comprises a control panel mounted on the interior of the boat, a plurality of tubular "T" shaped interconnection fittings in a raw sea water cooling conduit, and a fresh water flush valve therebetween. The components are connected for fresh water fluid flow with a plurality of standard radiator hoses. The fresh water flush valve has a valve plunger for establishing fresh water flow between the control panel and the "T" shaped interconnection fittings. Further, the fresh water flush valve has a plurality of axial outlet ports to proportionally direct the flow of fresh water to the appropriate "T" shaped interconnection fitting in the raw sea water cooling conduit of the marine engine. A valve plug is provided to secure a positive closure when the fresh water flow is disconnected. The valve plug has a tapered body and an "O" ring to effect a positive seal and ensure that no fluid backflow occurs when the flushing system is not in use and operation of the marine engine is operating under normal conditions in sea water. All of the fixed and moveable parts are fabricating from material that resists salt air and salt water corrosion.

U.S. Pat. No. 4,533,331, which issued to Bland on Aug. 6, 1985, described a vent and drain assembly for marine propulsion devices. An outboard motor includes a powerhead shroud defining an engine compartment for an internal combustion engine and a vent and drain assembly for ventilating the engine compartment to the atmosphere and for draining liquids, such as water, from the engine compartment. The vent and drain assembly includes a valve member movably disposed in an aperture at a low point in the bottom wall of the powerhead shroud opening the engine compartment to the atmosphere. The valve member includes a domed portion which extends through the aperture and defines a cavity for entrapped air and an annular sealing flange which is located exteriorly of the shroud bottom wall. The valve member is held by gravity in an open position wherein the sealing flange is displaced outwardly from the shroud bottom wall for ventilation and draining and is moved to a closed position wherein the sealing flange is in sealing engagement with the shroud bottom wall in response to a rise in the water level above the shroud bottom wall.

U.S. Pat. No. 6,050,867, which issued to Shields et al on Apr. 18, 2000, discloses a drain system for a marine vessel. The drain system is provided for a marine vessel in which three types of drain operations can be performed at one common location near the transom of the marine vessel. A multiple conduit structure is provided with a plurality of fluid passages extending at least partially through its structure. A first fluid passage allows the bilge of the boat to be drained. A second fluid passage allows multiple locations on the engine to be drained through a common port. A second sealing plug is provided to close the second passageway that prevents fluid communication between the various fluid conduits used to drain the cooling water of the engine. A third fluid passage is provided through the multiple conduit structure to allow lubricating oil to be drained from the engine. A single hole through the transom of the boat is all that is required to allow the multiple conduit structure to be attached to the boat and extend through the transom for the purpose of draining the bilge, the engine cooling water, and the engine lubricating fluid.

U.S. Pat. No. 5,628,285, which issued to Logan et al on May 13, 1997, discloses a drain valve for a marine engine. The drain valve assembly for automatically draining water from a cooling system of a inboard marine engine when the ambient temperature drops to a preselected value is described. The drain valve includes a cup-shaped base having a group of inlets connected to portions of a cooling system of the engine to be drained, and an open end of the base is enclosed by a cover. Each inlet defines a valve seat and a sealing piston is mounted for movement in the base and includes a series of valve members that are adapted to engage the valve seats. An outlet is provided in the side wall of the cup-shaped base. The valve members on the sealing pistons are biased to a closed position by a coil spring and a temperature responsive element interconnects the sealing piston with the cover. The temperature responsive element is characterized by the ability to exert a force in excess of the spring force of the coil spring when the ambient temperature is above approximately 50 degrees F., to thereby maintain the valve members in the closed position. When the temperature falls below the selected temperature, the temperature responsive element will react, thereby permitting the valve members to be opened under the influence of the spring to automatically drain water from the cooling system of the engine.

U.S. Pat. No. 4,875,884, which issued to Meisenburg on Oct. 24, 1989, discloses a marine propulsion device with a thru-transom engine oil drain system. A fluid flow tube is provided which extends from the lower portion of the engine oil pan to a point on the boat transom below the pan. The upper end portion of the tube is connected through a control valve which communicates with the pan interior. The lower or discharge tube end portion is connected through a fitting extending through the transom. A removal plug is associated with the fitting and, when removed, permits oil to drain out through the transom and into an oil receptacle when the control valve is open.

U.S. Pat. No. 4,741,715, which issued Hedge on May 3, 1988, discloses a pressure actuated drain valve for marine drives. The pressure actuated drain valve for automatically draining the cooling water from a marine drive engine when the engine is stopped is disclosed. The drain valve includes a spring-loaded diaphragm which moves to a closed position when the engine water pump is operating to close an outlet from the engine cavities to be drained. The diaphragm automatically moves to its open position when the engine water pump is off to open the outlet to allow cooling water to drain from the engine cavities.

U.S. Pat. No. 4,699,598, which issued to Bland et al on Oct. 13, 1987, describes a marine propulsion device water supply system. The propulsion device comprises an internal combustion engine, a propulsion unit adapted to be pivotally mounted on the transom of a boat for pivotal movement relative to the transom about a generally vertical steering axis, and about a generally horizontal tilt axis, the propulsion unit including a propeller operably connected to the engine, a pump for pumping water from the exterior of the propulsion unit to the engine, and a conduit extending from the pump to the engine and having a low point below both the pump and the connection of the conduit to engine, and a drain for draining water from adjacent the low point of the conduit.

U.S. Pat. No. 5,980,342, which issued to Logan et al on Nov. 9, 1999, discloses a flushing system for a marine propulsion engine. The system provides a pair of check valves that are used in combination with each other. One of the check valves is attached to a hose located between the circulating pump and the thermostat housing of the engine. The other check valve is attached to a hose through which fresh water is provided. Both check valves prevent water from flowing through them unless they are associated together in locking attachment. The check valve attached to the circulating pump hose of the engine directs a stream of water from the hose toward the circulating pump so that the water can then flow through the circulating pump, the engine block, the heads, the intake manifold, and the exhaust system of the engine to remove sea water residue from the internal passages of the surfaces of the engine. It is not required that the engine be operated during the flushing operation.

U.S. Pat. No. 6,135,064, which issued to Logan et al on Oct. 20, 2000, discloses a marine drain system. An engine cooling system is provided with a manifold that is located below the lowest point of the cooling system of the engine. The manifold is connected to the cooling system of the engine, a water pump, a circulation pump, the exhaust manifold of the engine, and a drain conduit through which all of the water can be drained from the engine.

U.S. Pat. No. 6,089,934 which issued to Biggs et al on Jul. 18, 2000, discloses an engine cooling system with a simplified drain and a flushing procedure. An engine cooling system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which is, in turn, attached to a handle. By manipulating the handle, the tether forces the retainer to slide along the flexible conduits and control the position of second ends of the flexible conduits. This allows the system to be moved from a first position with the second ends of the conduits above the first ends of the conduits to a second position with the second ends of the conduits below the first ends and in the bilge of the boat. The system allows an operator to stand in a single location and move the drain system from the first and second position and back again without having to reach down into the engine compartment to remain drain plugs. The system allows the cooling system to be easily drained or flushed.

When a boat operator intends to drain the water from the cooling system of a marine propulsion device, the various drain conduits must be opened to allow the water to flow out of the engine cooling system and into either the bilge of the boat or overboard. Although many different devices have been developed to facilitate this procedure, some means must be provided to actually open the conduits. This could be the manual procedure of unthreading plastic plugs from drain openings on the engine, activating electrical switches which, in turn, cause remote valves to open to allow water to drain from the engine, or manually manipulating hoses to accomplish this process.

It would therefore be significantly beneficial if a means could be provided whereby a boat operator could easily and simply command the opening of all drain conduits, from a single remote position conveniently accessible to the boat operator, in order to cause the draining of the engine cooling system to occur. It would be further beneficial if this procedure could be accommodated without the need for electrical wires extending between the boat operator's position and the position of the various drain valves located around the engine. It would also be significantly beneficial if this procedure could be accomplished without the need of electrical or mechanical power provided by other than manual means.

SUMMARY OF THE INVENTION

A drain system for a marine propulsion apparatus made in accordance with the preferred embodiment of the present invention comprises a cooling water conduit system which is connectable in fluid communication with an engine of the marine propulsion apparatus. The cooling water conduit system can be, in its simplest embodiment, a simple drain hose connected to a drain location on the engine or its associated cooling system. The present invention further comprises a first pressure actuated valve disposed in fluid communication with the cooling water conduit system. In its simplest form, the pressure actuated valve is a pneumatic valve connected in fluid communication with the cooling water conduit system and having a closed status and an open status. In the closed status, flow through the drain hose for the cooling water conduit system is blocked while in the open status, this flow is permitted. The present invention further comprises a pressure controller connected in fluid communication with the first pressure actuated valve. In its simplest form, the controller comprises a manifold housing that distributes pressure from a central location to one or more pressure actuated valves connected to it. The pressure controller housing provides a means to connect incoming fluid flow that provides a pressurized fluid to the pressure actuated valve to change its status. In certain embodiments of the present invention, the controller also provides indicators, or visual annunciators, that indicate that the valve has moved to an open drain position. The indicators will only extend from their housings when the valve has completely opened. When this occurs, supply pressure is allowed to enter the indicator lines. Although these indicators are technically pressure indicators, the pneumatic connections result in their being indicators that the drain valve has opened as intended and that draining of the engine cooling system is occurring. The present invention further comprises a first pressure conduit connected in fluid communication between the first pressure actuated valve and the controller. The first pressure conduit transmits the pressure from the controller to the pressure actuated valve and allows the status of the pressure actuated valve to be changed from open status to closed status or from closed status to open status. In order to accomplish these actions, the controller can also be provided with a pressure relief valve that is manually operated.

The drain system of the present invention can further comprise an engine having an internal cooling system within the block of the engine wherein the cooling water conduit system is connected in fluid communication with the internal cooling system. This connection is typically accomplished by connecting one end of the cooling water conduit system to a drain opening in either the engine block, a component of the water cooled exhaust system, or any other drain location.

The present invention can further comprise a source of pressure connected in fluid communication with the controller. The source of pressure can be a motor driven compressor or, preferably, a hand pump that allows the boat operator to manually increase the pressure within the manifold of the controller and within the first pressure conduit in order to change the status of the first pressure actuated valve and, as a result, allow the cooling water to drain from the engine and its associated components. It should be understood that the first pressure actuated valve can be a pneumatically controlled valve or, in alternative embodiments, can be a hydraulically controlled valve.

In certain embodiments of the present invention, a second pressure actuated valve can be connected to the controller by a second pressure conduit, wherein both the first and second pressure conduits are connected in fluid communication with the manifold of the controller.

A pressure relief mechanism can be connected in fluid communication with the controller and can be manually actuated to relieve pressure within the controller and within the first and second pressure conduits to deactivate the first and second pressure actuated valves.

In certain embodiments of the present invention, one of the pressure actuated valves can be attached to a cooling water manifold which has internal passages and which is connected in fluid communication with the internal cooling system within the block of the engine. The cooling water manifold is disposed below the level of the lowest portion of the internal cooling system which normally retains cooling water when the engine is not operating. The first pressure actuated valve is connected to a drain opening of the cooling water manifold. A cooling water manifold of this type is disclosed in detail in U.S. Pat. No. (M09334), which is described above.

By providing pressure actuated drain valves, the present invention allows a boat operator to remotely actuate these drain valves by providing pressure at a centralized location at the controller. This arrangement avoids the need for complex mechanical devices to accomplish the draining procedure and also avoids the need for electrical wires extending from the boat operator's position at the controller and extending to the various drain valves. Instead, the present invention allows the boat operator to pneumatically actuate the pressure actuated valves and to accomplish the draining procedure in a convenient and safe manner.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
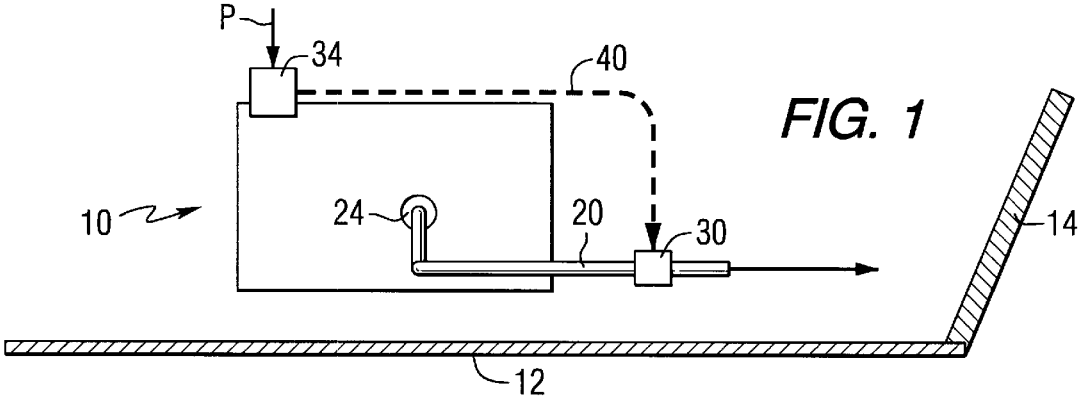
FIG. 1 is a highly simplified schematic representation of a simple marine propulsion system and an associated drain conduit.

Throughout the description of the preferred embodiment of the present invention, like components will be identified by like reference numerals.

FIG. 1 is a highly simplified schematic representation of the engine 10 located within a marine vessel. The engine 10 is shown in position with respect to the floor 12 and transom 14 of the marine vessel. A cooling water conduit 20, or drain conduit, is shown extending from a drain opening 24 of the engine 10 and having an opposite end of the drain conduit 20 located to permit cooling water to drain from the engine 10 into the bilge of the marine vessel. It should be understood that an alternative embodiment of the present invention could allow the cooling water to drain overboard. A pressure actuated valve 30 is disposed in fluid communication with the cooling water conduit system as shown. The pressure actuated valve is connected in fluid communication with a pressure controller 34 by a pressure conduit 40 which is represented by dashed arrows in FIG. 1. Pressure P can be introduced at the pressure controller 34. This fluid flow is introduced into a manifold of the pressure controller 34 and increases the pressure within the pressure conduit 40. The increased pressure is transmitted to the pressure actuated valve 30.

The pressure actuated valve 30 has a closed status whereby flow through the drain conduit 20 is blocked and, alternatively, an open status whereby flow through the drain conduit 20 is permitted. The pressure actuated valve 30, in a preferred embodiment of the present invention, is normally closed and this closed status can be changed by increasing the pressure in the controller 34 and the pressure conduit 40 above a preselected threshold value. When the operator causes pressure P to be introduced at the controller 34, the status of the pressure actuated valve 30 changes and water drains from the cooling system of the engine 10, through drain conduit 20, and into the bilge of the marine vessel or, alternatively, overboard through an opening in the transom 14.

Figure 2:
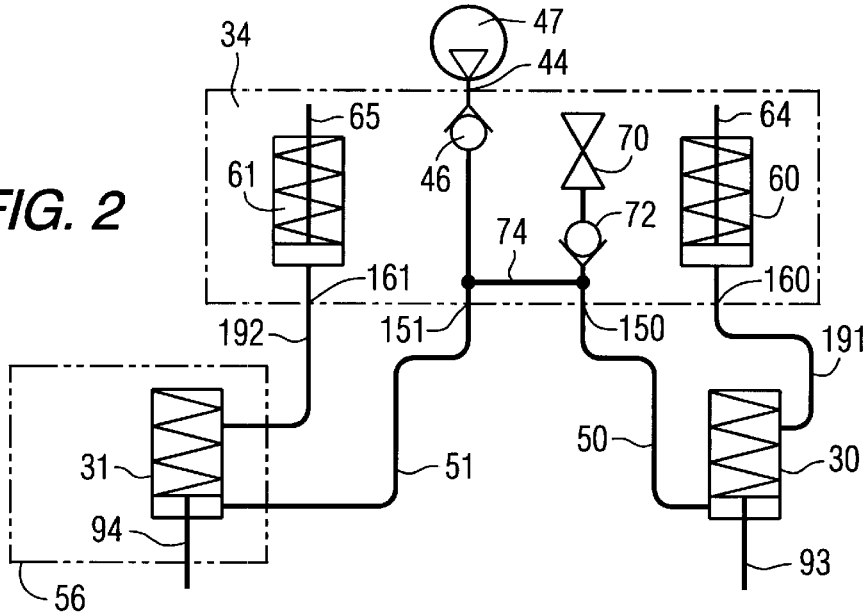
FIGS. 2 and 3 are pneumatic circuits of two embodiments of the present invention.

FIG. 2 illustrates the pneumatic circuit of the present invention. The pressure controller 34 comprises an inlet 44 to which a source of pressure 47 can be connected. It should be understood that the source of pressure 47 can be a manually operated hand pump which is capable of providing air pressure into and through the Schrader valve or, alternatively, a portable fluid pressure reservoir, such as pressurized air cylinder. Both the manually operated hand pumps and portable air pressure cylinders are widely known to those skilled in the art and available in commercial quantities at virtually any bicycle shop. Since the Schrader valve 46 is similar to the valves used on pneumatic tires, such as tires for automobiles, motorcycles, and bicycles, these pressure sources are well known to those skilled in the art and will not be described in detail herein. The pressure is directed through passages within the controller 34 to one or more pressure conduits and associated pressure actuated valves. A check valve 46, such as a Schrader valve, prevents pressure from escaping through the inlet 44. The pressure is transmitted through opening 150 and pressure conduit 50 to a first pressure actuated valve 30 which is connected in fluid communication with one particular location of a cooling water conduit system 20. Pressure is also transmitted through opening 151 and a second pressure conduit 51 to a second pressure actuated valve 31. In the particular arrangement shown in FIG. 2, the second pressure actuated valve 31 is associated with a water manifold 56 that will be described in greater detail below.

With continued reference to FIG. 2, the pressure controller 34 is provided with two pressure indicators, 60 and 61. The pressure indicators each have visual annuciators, 64 and 65, which allows the boat operator to recognize that the drain valves have opened and, furthermore, that the indicator lines have been connected to the supply pressure lines as described above. In addition, a relief valve 70, which is associated with a check valve 72, allows the pressure in the system to be manually released under the control of the boat operator. The present invention also incorporates a relief valve to automatically relieve pressures in excess of 70 PSI. This is provided as a safety feature in order to prevent the pneumatic system from being over pressurized.

With continued reference to FIG. 2, it can be seen that the visual indicators, 64 and 65, are spring loaded toward a retracted position and provide their visual signals only in response to pressure provided from their associated pressure actuated valves, 30 and 31. These visual signals only occur after the valves have successfully opened completely and the actuating pressure is ported to the indicator lines. In addition, it can be seen that the pressure actuated valves, 30 and 31, are spring loaded to an extended or closed position and are open only in response in an increase in pressure within their respective pressure conduits, 50 and 51. In FIG. 2, it can also be seen that the pressure conduits, 50 and 51, are connected to a common manifold 74 within the pressure controller 34.

Figure 3:
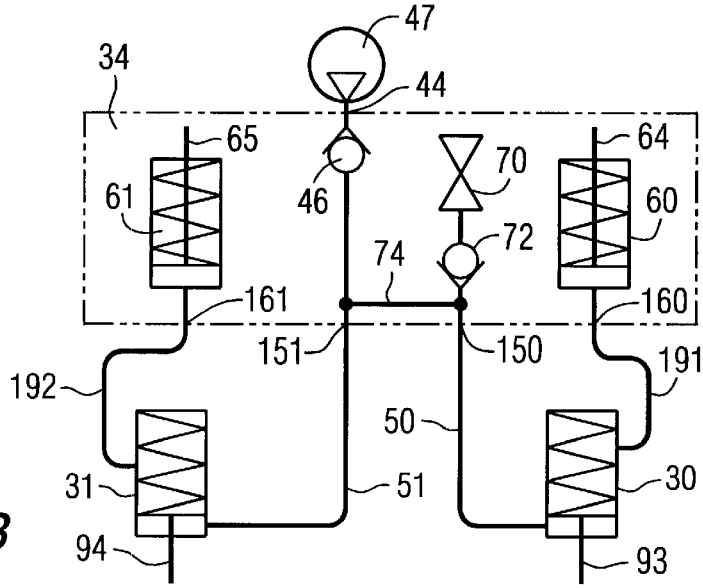

FIG. 3 is similar to FIG. 2, but the second pressure actuated valve 31 is not associated with the water manifold 56 as it is in the embodiment of FIG. 2. In FIG. 3, each of the first and second pressure actuated valves, 30 and 31, are associated with positions within the cooling water conduit system. However, the embodiment of FIG. 2 places one of the pressure actuated valves, such as the second pressure actuated valves 31, in association with a water manifold 56 such as the one disclosed in U.S. Pat. No. 6,135,064 which is described above. It should be understood that the two embodiments shown in FIGS. 2 and 3 are both within the scope of the present invention and are intended to serve their purposes with regard to different types of water cooling systems for a marine propulsion device.

Figure 4:
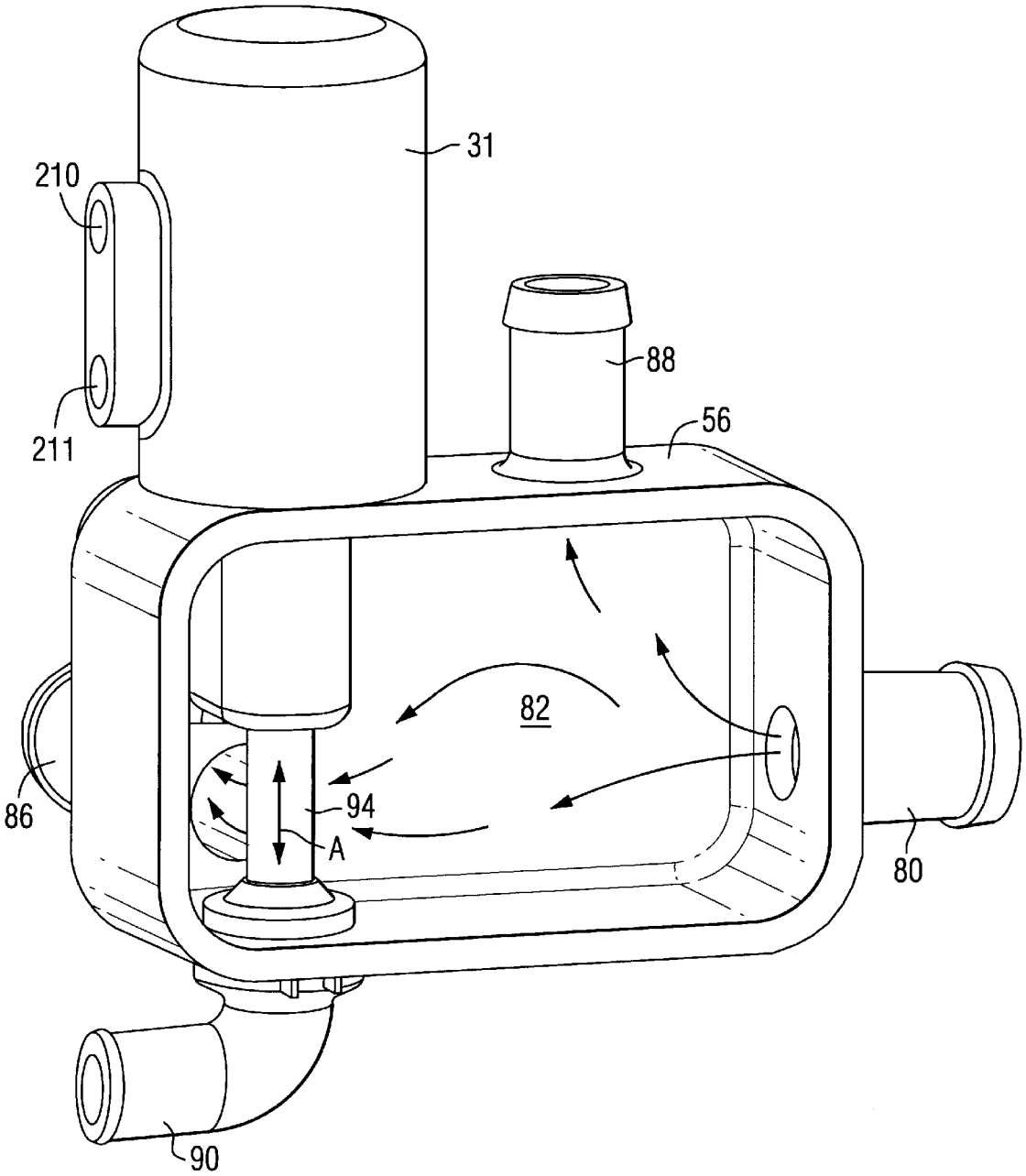
FIG. 4 is an isometric section view of a water manifold that is useable with the present invention in one preferred embodiment.

FIG. 4 shows a water manifold 56 as discussed above in conjunction with FIG. 2. The water manifold 56 has a water inlet 80 through which cooling water, such as lake water or sea water, flows into a central cavity 82. As disclosed in considerable detail in U.S. Pat. No. 6,135,064, significant advantages can be achieved through the use of a water manifold 56 through which all of the cooling water of an engine is forced to flow. The increased flow through such a device decreases the chances of blockage by silt and other debris. It also provides a centrally located drain position that is advantageously located at a point lower than the lowest position of a cooling system in which water can be trapped during a draining procedure. Of the entire flow of water passing through inlet 80, most of the water passes through a first outlet 86 and into the cooling system of the engine. Excess water passes through a second outlet 88 and is conducted to the exhaust system of the engine before passing overboard and back to the lake or sea from which it was originally drawn. A drain outlet 90 is connected in fluid communication with the cavity 82, but normally blocked by a plunger 94 that moves up and down, as represented by arrow A in FIG. 4. The pressure actuated valve 31 has a portion external to the water manifold 56, as shown, in which a spring provides a bias force on the plunger 94 that maintains it in the closed position shown in FIG. 4 until a preselected pressure magnitude is exceeded.

Figure 5:
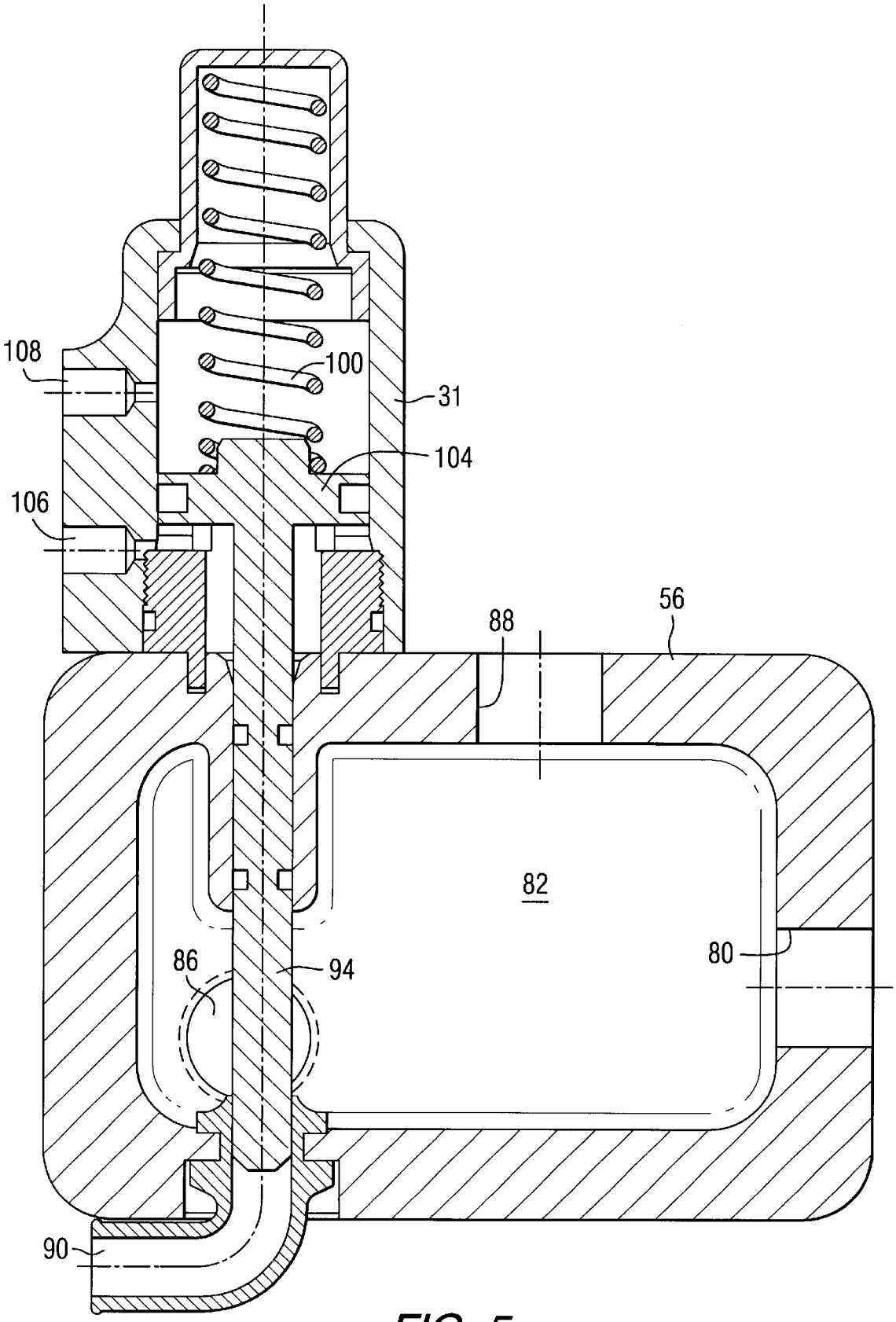
FIG. 5 is a section view of the illustration shown in FIG. 4.

FIG. 5 is a section view of the water manifold 56 and the pressure actuated valve 31 with the plunger 94 in its downward position to prevent water from flowing through the drain outlet 90 from the cavity 82. A spring 100 maintains the plunger 94 in this downward position unless it is overcome by pneumatic pressure in the region below the piston 104. Pressure is provided into this region, through opening 106 which is intended to be connected to pressure conduit 51 described above in conjunction with FIGS. 2 and 3. Opening 108 is intended to be connected to the pressure indicator 61 described above. With the plunger 94 in the position shown in FIG. 5, water flows from the inlet 80 and into the cavity 82 from which it can flow either through outlet 86 or outlet 88. With the plunger 94 in the position shown in FIG. 5, water will not drain through the drain outlet 90.

Figure 6:
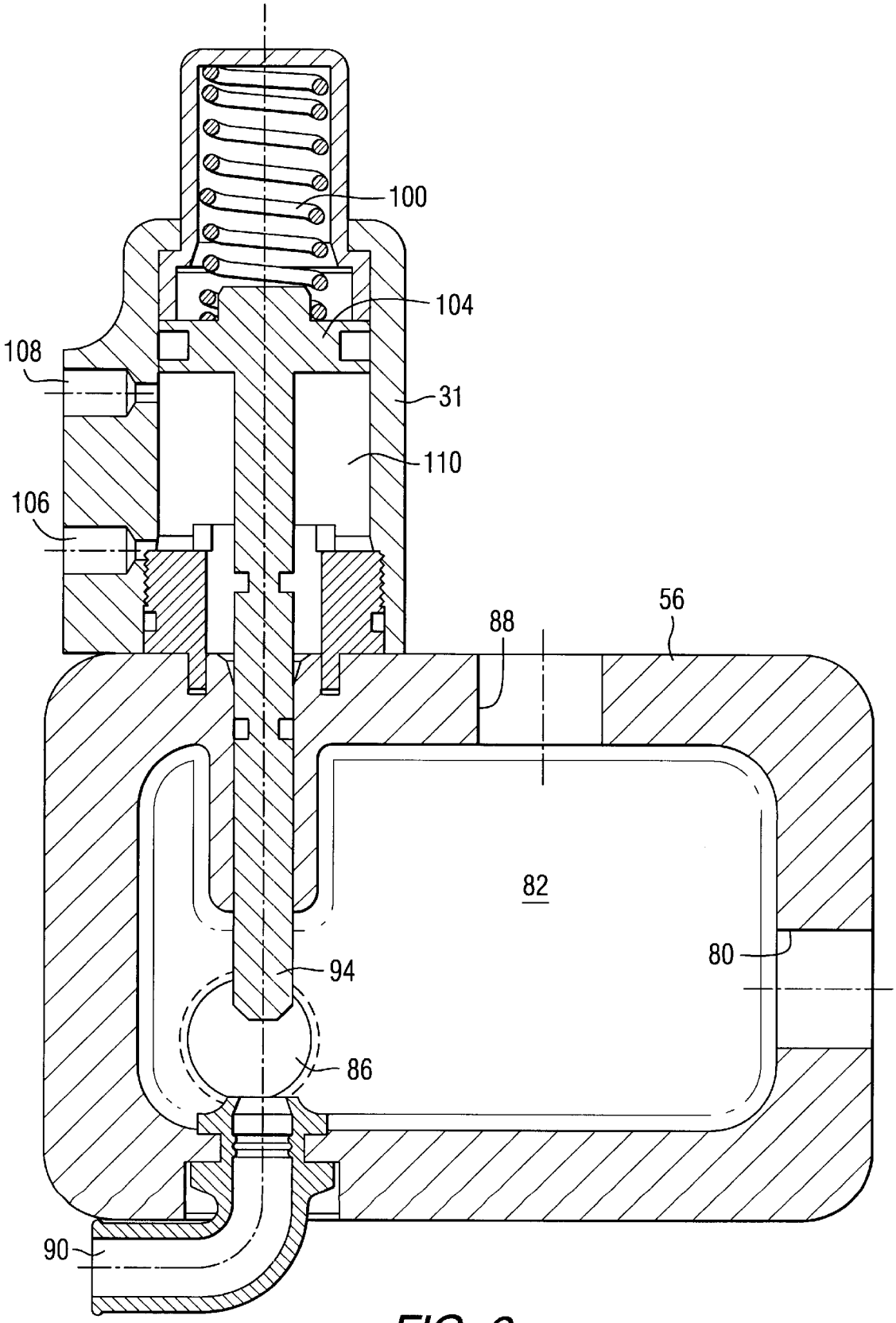
FIG. 6 is a section view of the device shown in FIG. 4, with the plunger in an opened position.

FIG. 6 is similar to FIG. 5, but with the plunger 94 moved into an upward position in response to increased pressure provided through opening 106 into the region identified by reference numeral 110 below the piston 104. When this pressure is sufficient to overcome the force exerted by the spring 100, the drain outlet 90 is opened and water can drain from the engine cooling system, through cavity 82 and into either the bilge of the marine vessel or, alternatively, overboard. The pressure indicators are actuated only after the valve successfully opens. The visual indicators extend from the pressure indicators only when their pressure lines are ported to the supply pressure lines as a result of the valve moving to a completely opened position.

Figure 7A:
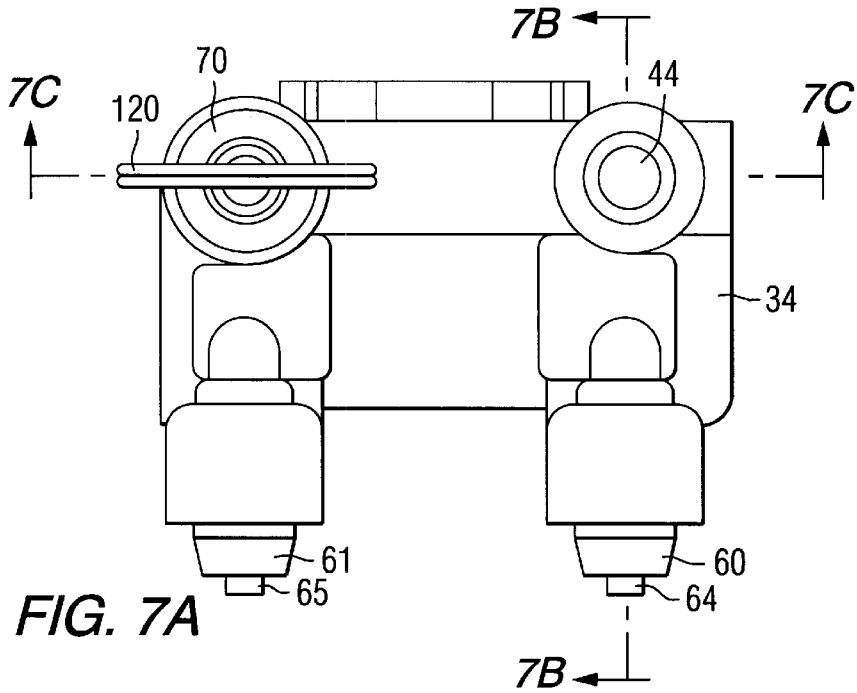
FIGS. 7A–7C show several views of the pressure controller with a manifold.
Figure 7B:
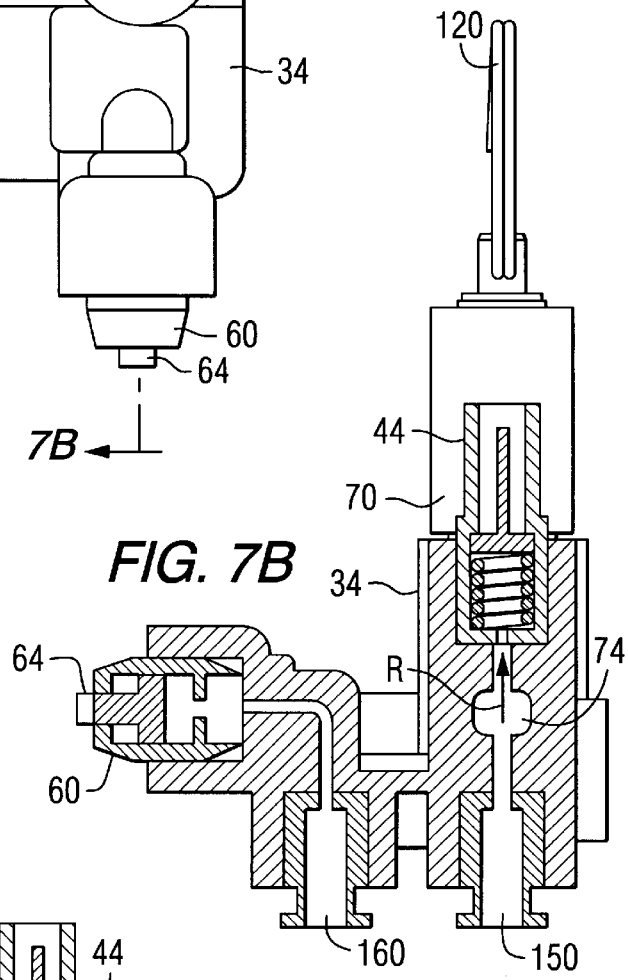
Figure 7C:
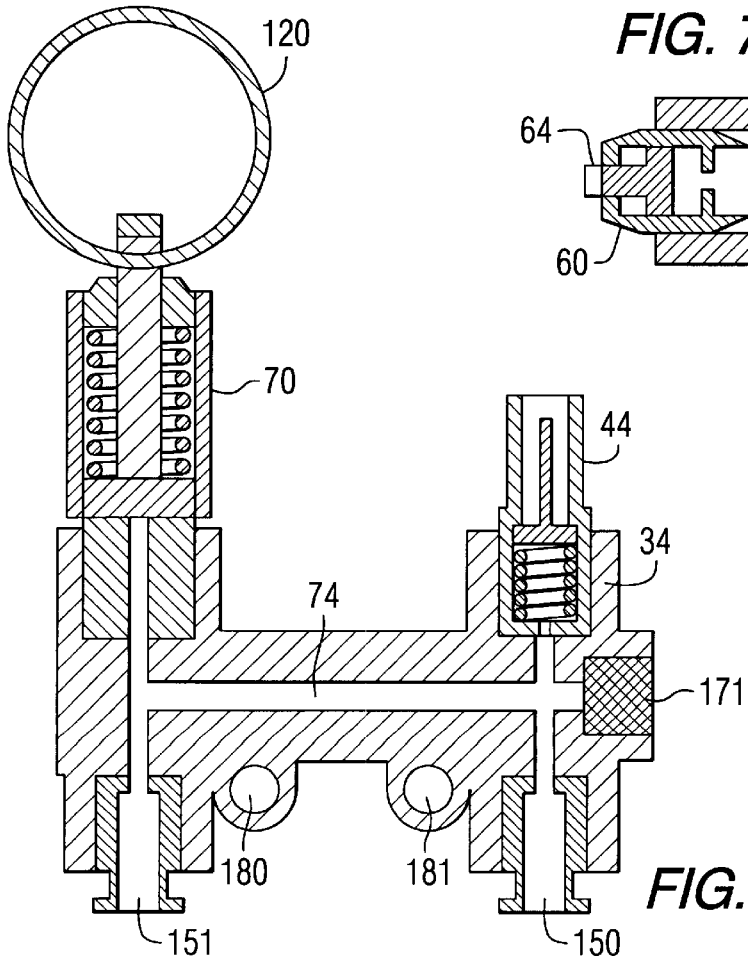

FIGS. 7B and 7C are section views of the pressure controller 34 shown in FIG. 7A, showing the manifold passage 74, the pressure indicators, and the openings that are shaped to be attached to pressure conduits. Pressure is provided at inlet 44, by some suitable source of pressure such as a hand operated pump or a compressor. This pressurized fluid, such as air, is conducted to the manifold cavity 74 and to the pressure conduits described above. These pressure conduits transmit the pressure to the pressure actuated valves that are used to open various drain conduits throughout the system. When the valves are actuated, pressure is transmitted back to the pressure controller 34 through openings that actuate the pressure indicators and provide visual indications of the pressure to the boat operator. In addition, an opening is shaped to receive a relief valve 70 that is manually operated to purge pressure from the system and return the pressure actuated valves to their normally closed positions. The pressure relief valve 70 also automatically relieves pressure in excess of 70 PSI in its associated pressure lines.

FIG. 7A is a top view of the pressure controller 34 with an inlet 44 where pressure can be introduced into the manifold of the controller 34. A pressure relief valve 70, with a ring 120 to facilitate manual activation, allows a boat operator to relieve pressure within the system. The pressure indicators, 60 and 61, are shown with their visual indicators, 64 and 65.

FIGS. 7B and 7C are section views of FIG. 7A, as indicated. The ring 120 allows an operator to pull upward on the pressure relief valve 70 to allow air to escape as indicated by arrow R. Opening 150 is intended to be connected to a pressure conduit such as that identified as reference numeral 50 in FIGS. 2 and 3. Opening 160 is intended to be connected to a conduit that allows pressure from the pressure actuated valves to return and activate the pressure indicator 60.

FIG. 7C is a section view of FIG. 7A showing the pressure relief valve 70 with its ring 120 and also showing a Schrader valve 44 that allows the operator to connect a source of pressure such as a hand pump, to the valve in order to pressurize the manifold 74 within the pressure controller 34. Openings 150 and 151 shown in FIG. 7C are intended to be connected to pressure conduits that extend to associated pressure actuated valves. It should be understood that the plug 171 is used to facilitate manufacturing and to seal an end of the manifold 74 that would otherwise be open to the atmosphere as a result of the need to form the manifold 74 during the manufacturing operation. Holes 180 and 181 are intended to facilitate mounting of the pressure controller 34 at a location that is convenient for the operator.

With reference to FIGS. 2, 3, 7A, 7B, and 7C, it should be understood that pressure is introduced at inlet 44 and that pressure fills the manifold 74 within the structure of the pressure controller 34. Pressure is then available at openings 150 and 151 where the pressure conduits, 50 and 51, are connected to the pressure controller 34. When the plungers, 93 and 94, of the pressure actuated valves, 30 and 31 respectively, are sufficiently retracted to open their respective drain openings, the supply pressure in pressure conduits 50 and 51 is ported to the pressure lines that are connected between the pressure actuated valves, 30 and 31, and the pressure indicators, 60 and 61, respectively. In FIGS. 2 and 3, these pressure lines are identified by reference numerals 191 and 192. The return pressure is connected to the pressure controller 34 at openings 160 and 161 to allow the indicators, 60 and 61, to provide a visual indication to the operator that the pressure actuated valves, 30 and 31, are actuated and the drain passages are opened.

It should be understood that the check valves identified by reference numeral 72 and 46 in FIGS. 2 and 3 are provided by the internal mechanisms of the relief valve 70 and Schrader valve 44 described above in conjunction with FIGS. 7A, 7B, and 7C. In a preferred embodiment of the present invention, the actuating pressure within the pressure conduits, 50 and 51, is approximately 70 lbs per square inch in order to operate the two pressure actuating valves, 30 and 31. When the drain valves are new, they will open completely in response to approximately 20–30 PSI in their respective lines. The total system pressure is limited to 70 PSI by relief valve 70. The difference between the 70 PSI maximum line pressure and the new drain valve actuation pressure (20–30 PSI) serves as reserve capacity to overcome accumulated friction that can occur during normal operation. The valve rod surfaces can become degraded during actual use and, as a result, may require pressures greater than 20–30 PSI to be fully opened.

Figure 8:
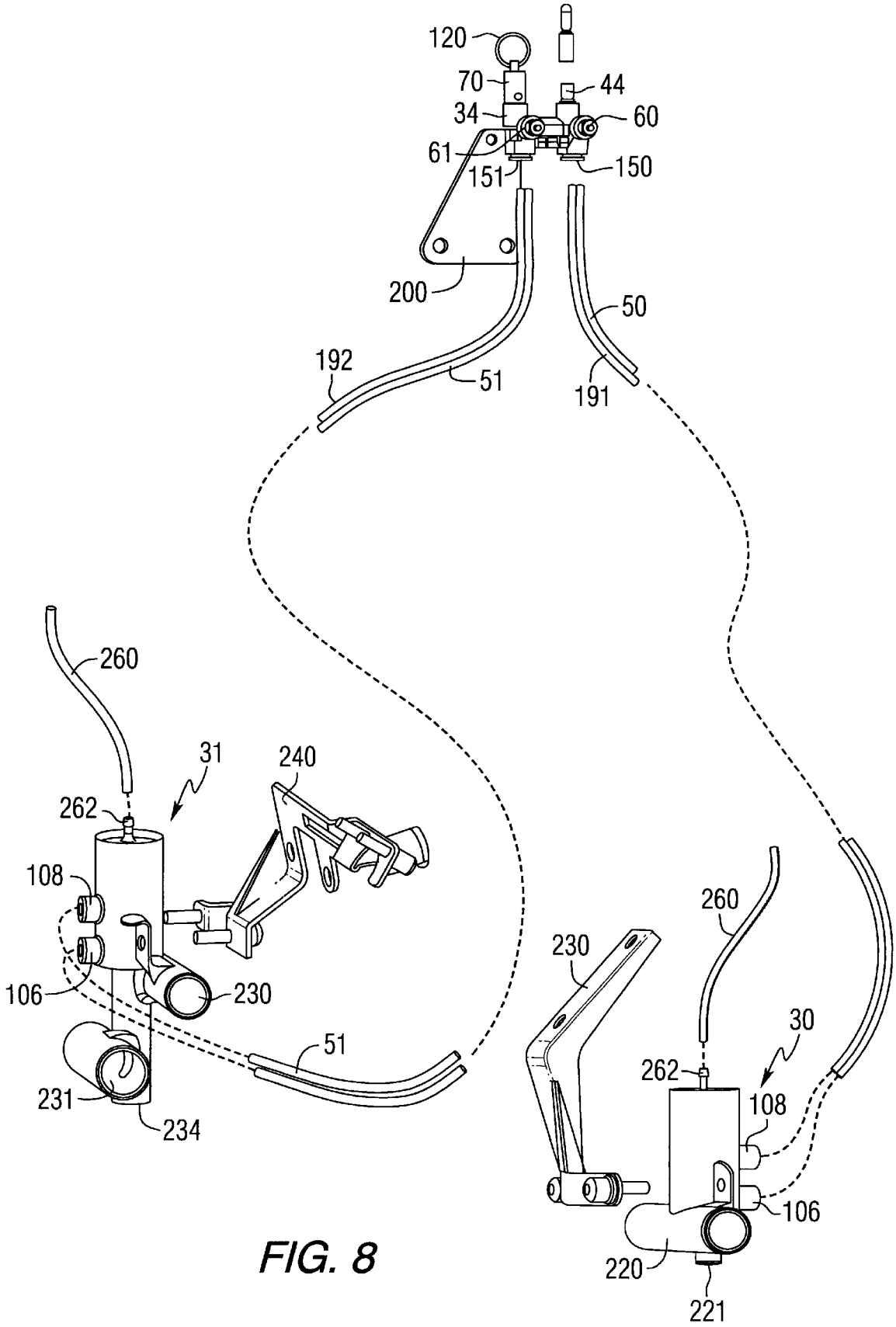
FIG. 8 is a partially exploded view of a system made in accordance with the present invention.

FIG. 8 is a partially exploded view showing the pressure controller 34 with a bracket 200 that allows the pressure controller 34 to be firmly attached to a convenient location near the marine propulsion system. The individual components of the pressure controller 34 are identified with reference numerals that allow them to be compared to FIGS. 7A, 7B, and 7C. The pressure conduits, 50 and 51, extend from openings, 150 and 151, of the pressure controller 34 and connect the pressure controller in fluid communication with the first and second actuated valves, 30 and 31. The first pressure actuated valve 30 is provided with pressure openings, 106 and 108, which are connected to an end of the pressure conduit 50. Although not shown in FIG. 8, it should be understood that the first pressure actuated valve 30 controls the vertical movement of a plunger, such as plunger 94 described above in conjunction with FIGS. 4, 5, and 6, that either blocks flow between a water conduit 220 and a drain conduit 221 or allows flow therebetween. Unless the pressure in the pressure conduit 50 exceeds a preselected threshold, the water conduit 220 and the drain conduit 221 are not in fluid communication with each other. When the internal plunger is raised, water is free to flow from the water conduit 220 to the drain conduit 221. Reference numeral 230 identifies a bracket that allows the first pressure actuated valve 30 to be mounted at a convenient location on an engine of a marine propulsion system.

With continued reference to FIG. 8, the second pressure actuated valve 31 is connected to the second pressure conduit 51 at the openings identified by reference numerals 106 and 108. The second pressure actuated valve 31 is connected to two separate water conduits, 230 and 231. When an internal plunger, not shown in FIG. 8, is raised by the pressure actuated valve 31, both water conduits, 230 and 231, are connected in fluid communication with a drain conduit 234 and they can drain downward through drain conduit 234. Reference numeral 240 identified as a bracket that allows the second pressure actuated valve 31 to be mounted at a convenient location on an engine. Typically, the first pressure actuated valve 30 would be mounted on one side of the engine and the second pressure actuated valve 31 would be mounted on an opposite of the engine. However, as described above, either one of the pressure actuated valves could also be mounted in fluid communication with a water manifold 56.

In FIG. 8, both pressure actuated valves are shown having a vent tube 260 extending upward from a vent nipple 262. This vent tube is not required in all embodiments of the present invention but, in certain embodiments, it allows improved operation of the valves by venting pressure on an opposite side of the internal piston than the side toward which pressure is provided through the pressure conduits. The return pressure lines, 191 and 192, connect the pressure in their associated pressure conduits, 50 and 51, to the pressure indicators, 60 and 61, when the piston in the associated pressure actuated valve, 30 and 31, reaches its full travel and the associated train valve is opened.

By using a pneumatically controlled system, the present invention allows a boat operator to remotely control various pressure actuated valves, but does not require electrical wiring to be extended proximate the engine to accomplish this purpose. Although the present invention has been described with particular detail and illustrated to show certain specific embodiments of the present invention, it should be understood that alternative embodiments are also within its scope.

We claim:

1. A drain system for a marine propulsion apparatus, comprising:

a cooling water conduit system connectable in fluid communication with an engine of said marine propulsion apparatus;

a first pressure actuated valve disposed in fluid communication with said cooling water conduit system;

a controller connected in fluid communication with said first pressure actuated valve;

a first pressure conduit connected in fluid communication between said first pressure actuated valve and said controller, said controller comprising an internal manifold connected in fluid communication with said first pressure conduit and a pressure indicator for indicating a change in pressure within said first pressure conduit.

2. The system of claim 1, further comprising:

an engine having an internal cooling system within a block of said engine, said cooling water conduit system being connected in fluid communication with said internal cooling system.

3. The system of claim 2, further comprising:

a cooling water manifold having internal passages and connected in fluid communication with said internal cooling system within said block of said engine, said cooling water manifold being disposed below the level of the lowest portion of said internal cooling system which normally retains cooling water when said engine is not operating, said first pressure actuated valve being connected to a drain opening of said cooling water manifold.

4. The system of claim 1, wherein:

said first pressure actuated valve is a pneumatically controlled valve.

5. The system of claim 1, further comprising:

a source of pressure connected in fluid communication with said controller.

6. The system of claim 5, wherein:

said source of pressure is a manually operated pump.

7. The system of claim 1, further comprising:

a second pressure actuated valve connected in fluid communication with said cooling water conduit system and with said controller; and a second pressure conduit connected in fluid communication between said second pressure actuated valve and said controller.

8. The system of claim 1, further comprising:

a pressure relief mechanism connected in fluid communication with said controller.

9. The system of claim 8, wherein:

said pressure relief mechanism is manually actuated to relieve pressure within said controller and said first pressure conduit to deactivate said first pressure actuated valve.

10. A drain system for a marine propulsion apparatus, comprising:

a first drain conduit;

a first pressure actuated valve connected in fluid communication with said first drain conduit, said first pressure actuated valve having a closed status whereby flow through said first drain conduit is blocked and an opened status whereby flow through said first drain conduit is permitted;

a pressure controller connected in fluid communication with said pressure actuated valve; and a first pressure conduit connected in fluid communication between said pressure controller and said first pressure actuated valve, said pressure controller comprising an internal manifold connected in fluid communication with said first pressure conduit and a pressure indicator for visually indicating a change in pressure within said first pressure conduit.

11. The system of claim 10, wherein:

a pressure from said pressure controller within said pressure conduit greater than a preselected magnitude causes said pressure actuated valve to assume said opened status to allow water to flow through said first drain conduit.

12. The system of claim 11, further comprising:

a source of fluid pressure connected to said pressure controller.

13. The system of claim 12, wherein:

said source of fluid pressure is a manually operated pump.

14. The system of claim 10, further comprising:

a second drain conduit;

a second pressure actuated valve connected in fluid communication with said second drain conduit, said second pressure actuated valve having a closed status whereby flow through said second drain conduit is blocked and an opened status whereby flow through said second drain conduit is permitted; and a second pressure conduit connected in fluid communication between said pressure controller and said second pressure actuated valve.

15. The system of claim 10, further comprising:

an engine having an internal cooling system within a block of said engine, said first drain conduit being connected in fluid communication with said internal cooling system of said engine.

16. The system of claim 15, further comprising:

a cooling water manifold having internal passages and connected in fluid communication with said internal cooling system within said block of said engine, said cooling water manifold being disposed below the level of the lowest portion of said internal cooling system which normally retains cooling water when said engine is not operating, said first pressure actuated valve being connected to a drain opening of said cooling water manifold.

17. A drain system for a marine propulsion apparatus, comprising:

a first drain conduit;

a first pressure actuated valve connected in fluid communication with said first drain conduit, said first pressure actuated valve having a closed status whereby flow through said first drain conduit is blocked and an opened status whereby flow through said first drain conduit is permitted;

a pressure controller connected in fluid communication with said pressure actuated valve;

a first pressure conduit connected in fluid communication between said pressure controller and said first pressure actuated valve;

a second drain conduit;

a second pressure actuated valve connected in fluid communication with said second drain conduit, said second pressure actuated valve having a closed status whereby flow through said second drain conduit is blocked and an opened status whereby flow through said second drain conduit is permitted; and a second pressure conduit connected in fluid communication between said pressure controller and said second pressure actuated valve, said pressure controller comprising an internal manifold connected in fluid communication with said first pressure conduit and a pressure indicator for visually indicating a change in pressure within said first pressure conduit.

18. The system of claim 17, wherein:

a pressure from said pressure controller greater than a preselected magnitude causes said first and second pressure actuated valves to assume said opened status to allow water to flow through said first and second drain conduits.

* * * * *